United States Patent [19]

Chang et al.

[11] 4,272,763

[45] Jun. 9, 1981

[54] SECURITY ATTACHE CASE WITH AUTOMATIC ALARM SYSTEM

[76] Inventors: Ben-Lee Chang, 12-7 Fl., 100, 3 Sec., Roservolt Rd., Taipei; Me-Fei Lee, P.O. Box 26-18, Taichung, both of Taiwan

[21] Appl. No.: 71,700

[22] Filed: Aug. 31, 1979

[51] Int. Cl.[3] ..... G08B 13/14; G08B 15/00

[52] U.S. Cl. ..... 340/571

[58] Field of Search ..... 340/571

[56] References Cited

U.S. PATENT DOCUMENTS

| | | | |
|---|---|---|---|
| 1,288,909 | 12/1918 | Jones | 340/571 |
| 4,155,079 | 5/1979 | Chiu et al. | 340/571 |
| 4,204,202 | 5/1980 | Pai | 340/571 |

*Primary Examiner*—Glen R. Swann, III

[57] ABSTRACT

An attache case with automatic alarm system has a pair of mirco switches mounted in the handle thereof. If the micro switches are actutated, the edges of the attache case will produce a high voltage electric shock, and if the attache case is moved an alarm is sent out. The electric shock and alarm are intended to prevent the attache case from being stolen.

7 Claims, 6 Drawing Figures

SECURITY ATTACHE CASE WITH AUTOMATIC ALARM SYSTEM

BACKGROUND OF THE INVENTION

1. Field of the Invention

The present invention relates to a security attache case with automatic alarm system which will produce high voltage electric shock and send out alarm signals.

2. Brief Description of the Prior Art.

Conventional attache cases are not equipped with alarm generating means to prevent the same from being stolen.

Recently, there has been developed a kind of attache case which includes a chain made of metal or leather to link the case with the wrist of the user. However such kind of cases usually cause much inconvenience to the users.

BRIEF SUMMARY OF THE INVENTION

It is a main object of the present invention to provide an attache case having a pair of micro switches installed in the handle to be actuated to generate a high voltage and low current electric shock to defeat the people who attempt to rob the attache case.

Another object of the present invention is to provide an attache case having an automatic alarm system to generate an alarm signal when the attache case is moved from its normal horizontal position.

According to the present inventin, the attache case comprises a case body, an inner case installed in said case body and being adjacent to the bottom thereof, a voltage step-up transforming circuit adopted in said inner case to raise the voltage, an alarm generating circuit installed in said inner case to generate an alarm signal, and a pair of micro switches mounted in the handle of the case; said micro switches being actuated to start said voltage step-up circuit to generate a high voltage by an electric shock means at the edges on the outer surfaces of the attache case.

BRIEF DESCRIPTION OF THE DRAWINGS

Those and other objects, features and advantages will become apparent from the following detailed description of the preferred embodiment with reference to the accompanying drawings.

DETAILED DESCRIPTION OF THE PREFERRED EMBODIMENT

Figure 1:
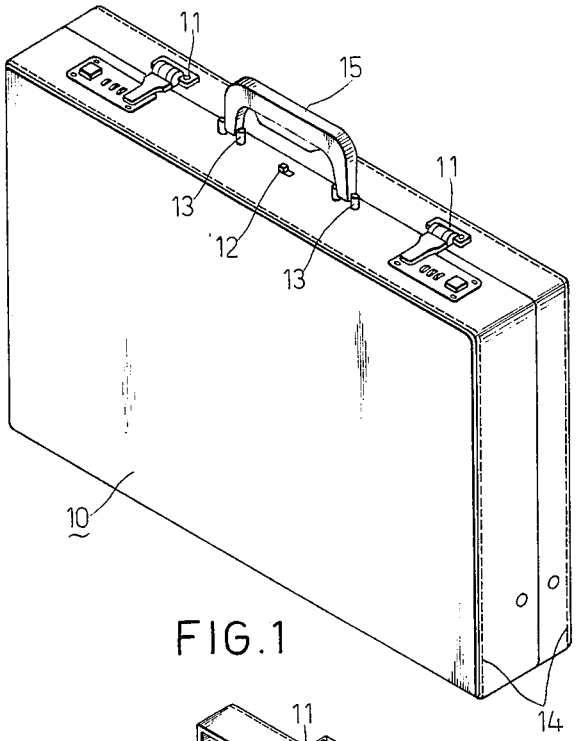
FIG. 1 is a perspective view of the attache case according to the present invention.

Referring to FIG. 1 which shows a perspective view of the attache case according to the present invention, the attache case 10 is similar to conventional cases in structure and consists of a case body, a pair of locks 11, a handle 15 attached to the case body through a pair of metal studs 13, and a switch 12. Each pair of metal studs 13 are communicated through case body 10 by a metal pin which is not shown in the drawings. At the edges of the outer surfaces of the attache case body, there are sewed a plurality of electric wires 14 which act as the high voltage electric shock means.

Figure 3:
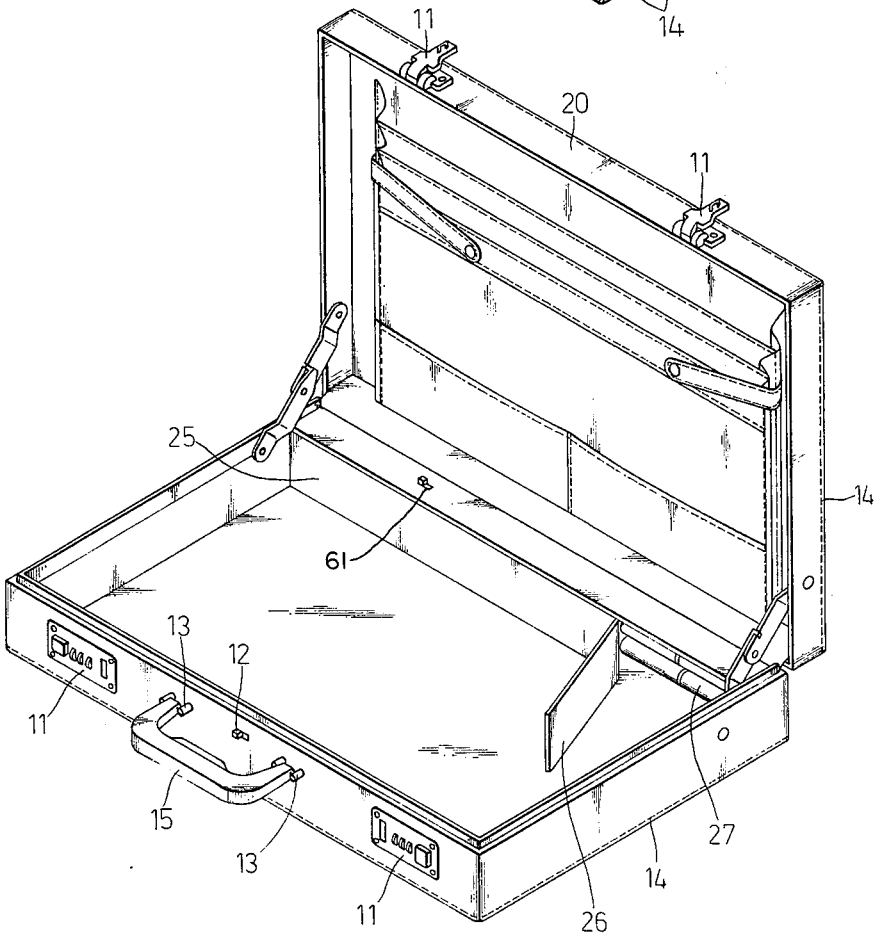
FIG. 3 is a perspective view of the attache case in FIG. 2 further with the cover of the inner case opened.
Figure 2:
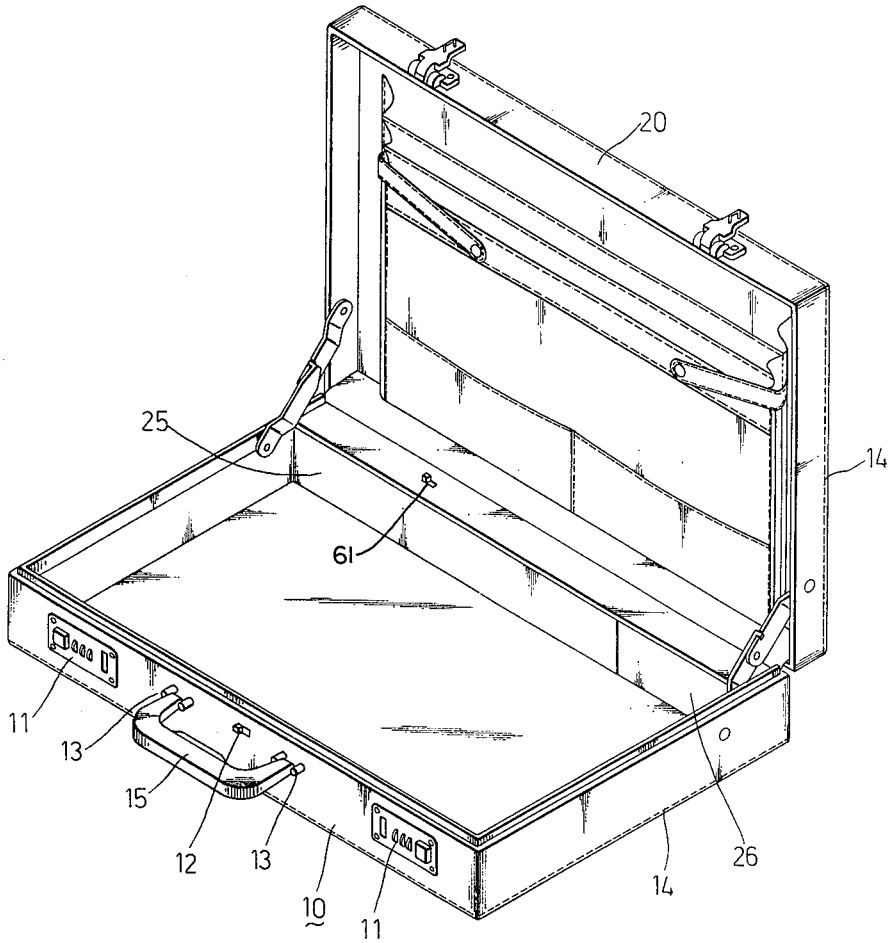
FIG. 2 is a perspective view of the attache case in FIG. 1 with the cover opened.

Referring to FIGS. 2 and 3 which show the attache case of the present invention with the cover 20 thereof opened, it is seen that an inner case 25 is provided within the case body. The inner case 25 further consists of a battery chamber enclosed by a cover 26 for containing the batteries 27. The electric circuits for use in the present invention are contained in the inner case 25.

Figure 4:
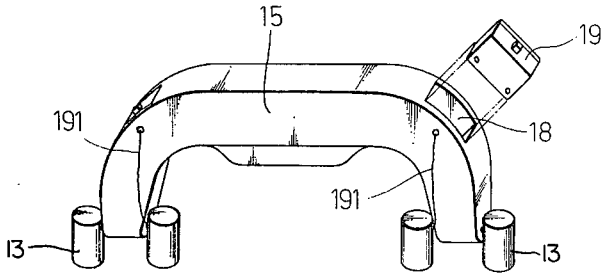
FIG. 4 is an enlarged exploded perspective view of the handle of the attache case according to the present invention.

Referring to FIG. 4 which shows the exploded view of the handle of the present invention, the handle 15 is made of plastic and wrapped by sheet leather. On the top surface of the handle 15, there are formed two square cavities 18 for receiving micro switches 19. Lead wires 191 are provided in the handle for connecting the micro switch 19 to the metal stud 13.

Figure 5:
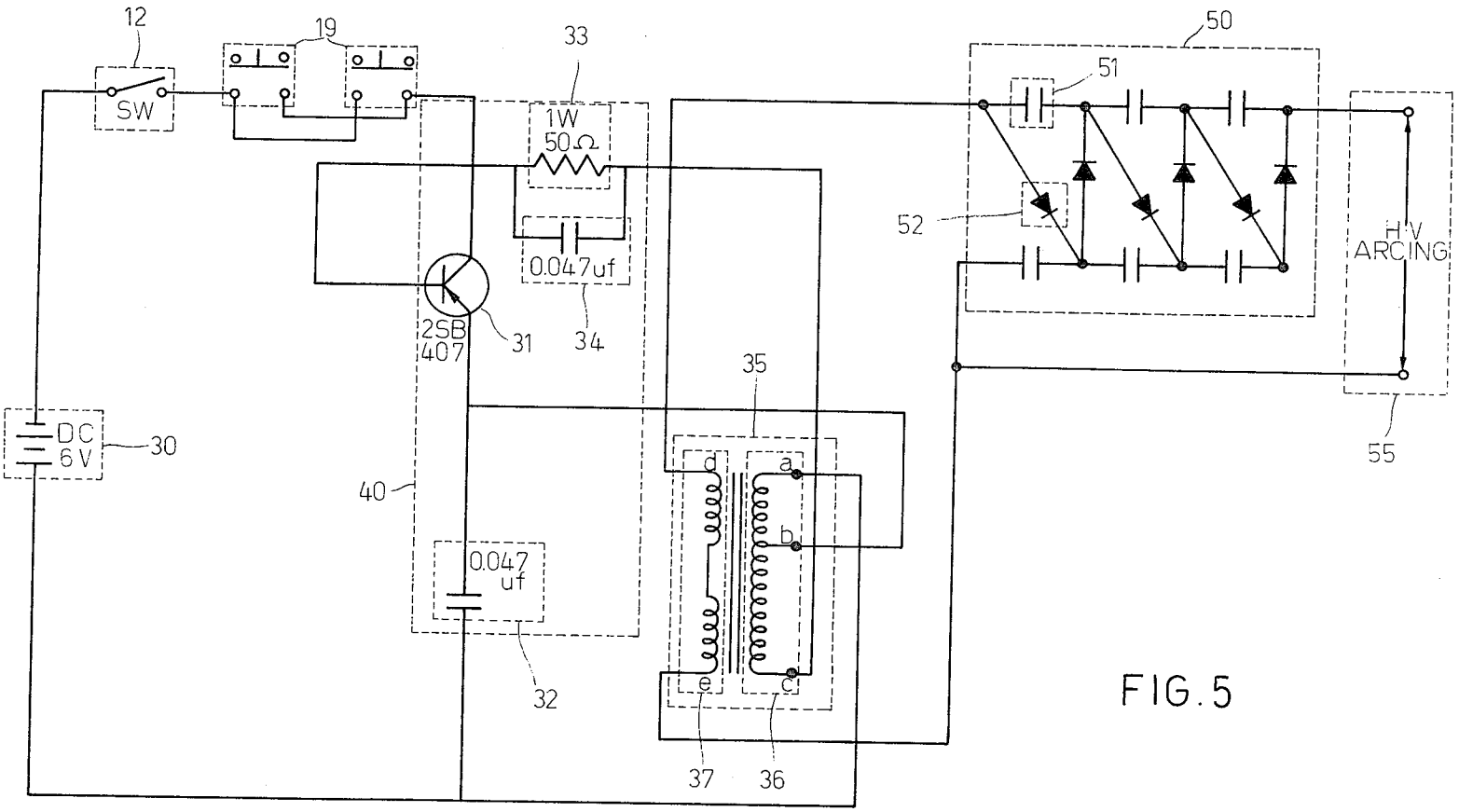
FIG. 5 is a circuit diagram of the voltage step-up transforming circuit used in the present invention.

Referring to FIG. 5 which shows a circuit diagram of the voltage step-up transforming circuit used in the attache case of the present invention, the 6-volt D.C. power supply 30 is connected to the switch 12 and the micro switches 19 in the handle 15. Two micro switches 19 are connected in parallel. The negative terminal of the power supply 30 is connected to the collector of a PNP transistor 31 via switches 19 and 12. The positive terminal of the power supply 30 is connected to the emitter of the transistor 31 through a bypass capacitor 32. The positive terminal of the power supply 30 is also connected to the terminal a of the primary coil 36 of the step-up transformer 35. The emitter of the transistor 31 is connected to the middle terminal b of the primary coil 36. The base of the transistor 31 is connected to the terminal c of the primary coil 36 through a resistor 33 which is further shunt by a capacitor 34. The transistor 31, resistor 33, capacitor 34 and capacitor 32 form a RC (resistor-capacitor) oscillation circuit 40. The output of the RC oscillation circuit 40 is fed into the primary coil 36 of the transformer 35. The step-up voltage on the secondary coil 37 of the transformer 35 is fed into a voltage multiplier 50 which consists of a plurality of capacitors 51 and diodes 52. The high-voltage and low-current output of the voltage multiplier 50 is fed to the electric wires 14 on the case body to defeat the theif.

Figure 6:
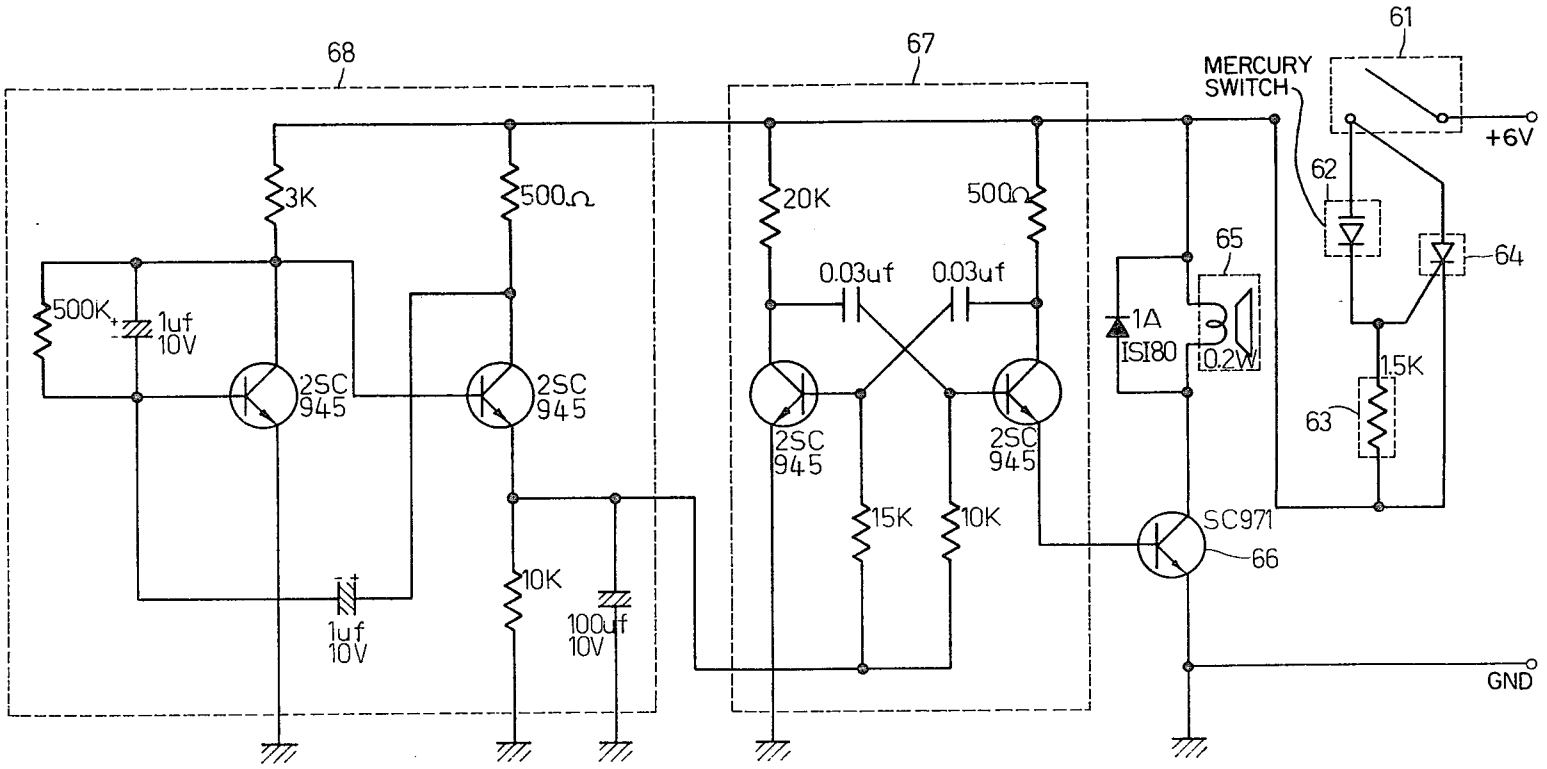
FIG. 6 is a circuit diagram of an automatic alarm generating circuit used in the attache case according to the present invention.

Referring to FIG. 6 which shows a circuit diagram of the alarm generating circuit used in the attache case of the present invention, the power supply may be a six volt D.C. power supply and is fed to the collector of an amplifier transistor 66 through a switch 61, a mercury switch 62 shunt by a thyristor 64, and a speaker 65. The power supply also feeds a bi-stable multivibrator 67 and a buzzer 68 which separately consist of two transistor and a plurality of resistors and capacitors. The operation of the said circuit is stated hereinbelow.

The case body 10 is placed horizontally, switch 61 is switched on and cover 20 is closed. If someone moves the case, the mercury switch 62 will be ON and the thyristor 64 will be triggered to conduct. The buzzer 68 generates a signal whose frequency of oscillation will be stabilized by the bi-stable multivibrator 67 and amplified by the amplifier transistor 66. The audio frequency output is sent out through the speaker 65 to scare away the thief.

It is further understood by those skilled in the art that the foregoing description is a preferred embodiment of the invention and that various changes and modifications may be made in the invention without departing from the spirit and scope thereof.

What is claimed is:

1. An attache case comprising a case body; a handle, said handle having a pair of cavities therein; an inner case installed in said case body; a voltage step-up transforming circuit and an alarm generating circuit mounted in said inner case; a pair of micro switches mounted in said cavities; electric wires disposed on the exterior of said case body; said micro switches being actuable to start said voltage step-up transforming circuit to generate a high voltage fed to said electric wires; and a movement sensitive switch disposed in said case body for activating said alarm generating circuit in response to movement of said case body.

2. The attache case according to claim 1, further including batteries and a compartment in said case body for holding said batteries, said batteries being coupled to said voltage step-up transforming circuit by said micro switches and connected to said alarm generating circuit by said movement sensitive switch.

3. The attache case according to claim 1 or 2, wherein said handle is attached to said case body and includes an upper surface disposed upwardly from said case body when said attache case is disposed in a normal carrying position, said cavities being formed in said upper surface.

4. The attache case according to claim 1, wherein said case body defines a geometric figure with peripheral edges and wherein said electric wires are disposed at the peripheral edges of said case body.

5. The attache case according to claim 4, wherein said electric wires disposed at the peripheral edges of said case body are stitched into said case body, whereby said electric wires appear as stitching.

6. The attache case according to claim 1, wherein said alarm circuit includes a thyristor coupled in parallel with said movement sensitive switch, an amplifier, a speaker, a power supply, means coupling said amplifier, speaker, power supply and movement sensative switch in series, and an electronic buzzer and multivibrator circuit operatively coupled to said amplifier.

7. The attache case according to claim 1 or 5, wherein said voltage step-up transforming circuit includes a power supply, an oscilator, means coupling said oscillator to said power supply via said micro switches, a step-up transformer having a primary winding and secondary winding, the primary winding being coupled to said oscillator, a voltage multiplier circuit comprising a plurality of operatively coupled capacitors and diodes, means coupling the secondary winding of said step transformer to said voltage multiplier circuit and means coupling the output of said voltage multiplier circuit to said electric wires.

* * * * *